United States Patent [19]

Diamond et al.

[11] Patent Number: 4,465,740

[45] Date of Patent: Aug. 14, 1984

[54] DECORATIVE MEDALLION AND METHOD AND MACHINE FOR MANUFACTURE

[75] Inventors: George B. Diamond, Anthony & Woodglen Rds., R.D., Glen Gardner, N.J. 08826; Ralph H. Helmrich, Glen Gardner, N.J.

[73] Assignee: George B. Diamond, Glen Gardner, N.J.

[21] Appl. No.: 376,967

[22] Filed: May 11, 1982

[51] Int. Cl.[3] ..... B32B 9/04

[52] U.S. Cl. ..... 428/542.2; 29/21.1; 29/432.1; 29/505; 29/252; 29/798

[58] Field of Search ..... 29/160.6, 505, 21.1, 29/91.3; 63/1, 2, 23; 428/542.2, 542.4

[56] References Cited

U.S. PATENT DOCUMENTS 1,936,726 1/1933 Mathewson ..... 29/91.3
3,041,031 6/1962 Pearson ..... 428/542.2
3,252,213 5/1966 Cuta ..... 29/21.1

*Primary Examiner*—F. Barry Shay
*Attorney, Agent, or Firm*—Ostrolenk, Faber, Gerb & Soffen

[57] ABSTRACT

The disclosure concerns a thonged medallion, method of assembling the same and apparatus for performing that method. The medallion includes a domed piece of metal having a flap bent into the interior of the dome, and the flap having a hook-like formation defined on the free edge thereof for cooperating with a hook-like formation on the opening in the element for clamping upon a thong inserted into the opening defined by the open flap. A continuous web of thong material is fed through a passageway into the opening in the dome-shaped element, a predetermined length of the web material is cut off, a stamping piston crimps the flap to clamp the thong in the opening.

8 Claims, 6 Drawing Figures

FIG. 1.
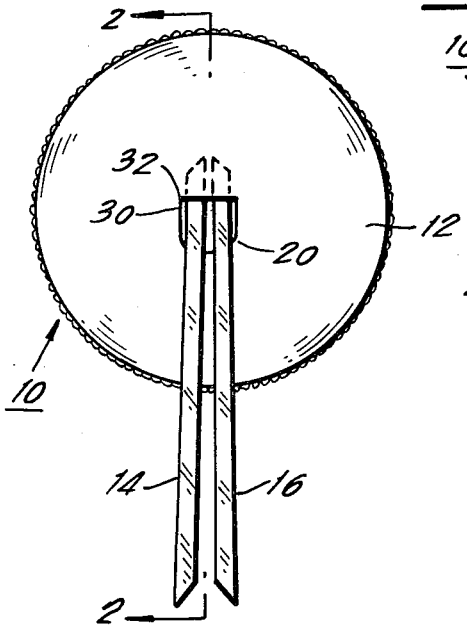
FIG. 2.
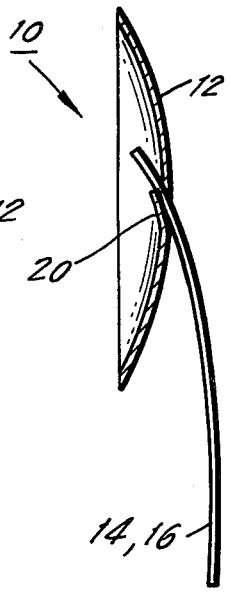
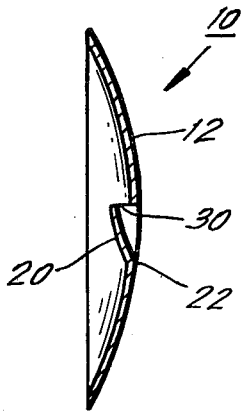
FIG. 4.
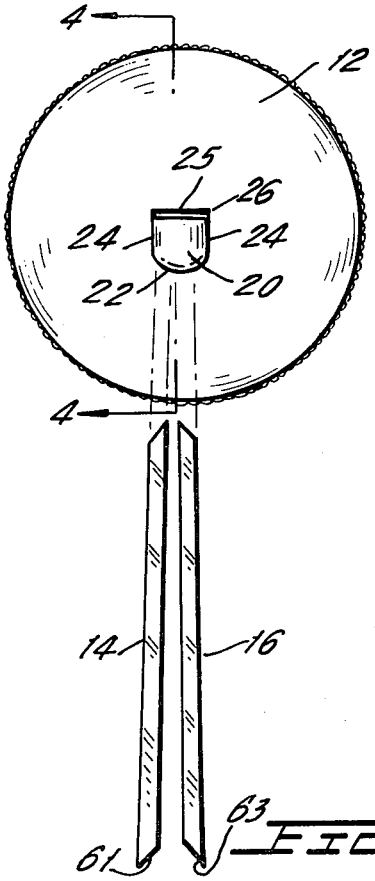
FIG. 3.
FIG. 5.
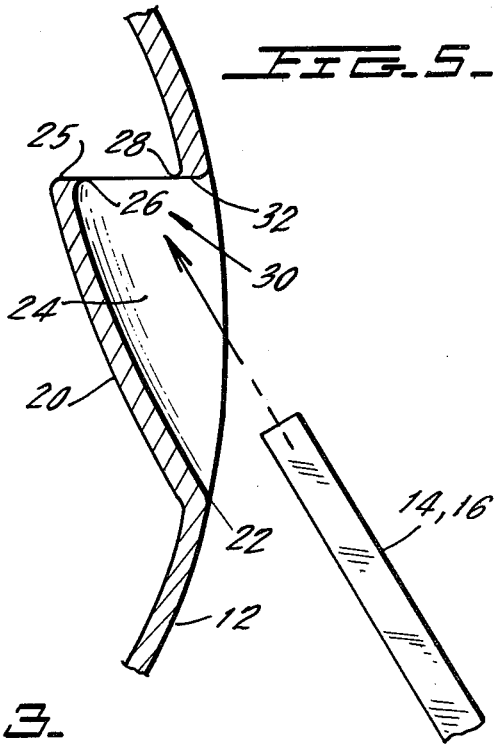

DECORATIVE MEDALLION AND METHOD AND MACHINE FOR MANUFACTURE

BACKGROUND OF THE INVENTION

The present invention relates to a decorative, domed metallic medallion with an attached thong, to its method of manufacture and to a machine for manufacturing it. On clothing, on packaging, as an artistic decoration, etc., one frequently used decorative medallion comprises a dome-shaped, metallic shell and a thong of leather, fabric, or the like, which is fastened in the shell and projects from the convex side thereof.

It has been conventional to punch a hole or slit in the metal shell, to thread the thong into the hole and to then fasten the thong in the hole by gluing it, knotting it, etc. Unfortunately, the thong was not held securely. Furthermore, this required a step of gluing, tieing, etc. and thus, the thonged medallion was not previously suitable for automated assembly.

SUMMARY OF THE INVENTION

The invention provides an improved medallion with a thong. The domed, metal medallion shell is stamped out of a thin sheet of metal in a die. The die includes a portion at the rounded part of the dome which cuts the dome to define a flap or louver which is bent or inclined into the dome. Preferably, the die is shaped to define a sharpened edge or barb at the free edge of the flap. The bent open flap defines an opening into which the thong is threaded. Thereafter, the flap is crimped against the thong, and the full closure of the flap clamps the thong to the medallion.

In a method of assembly and a machine for assembly of a medallion with a thong, the flexible thong material is fed in a continuous web from a spool and is threaded through the opening in the dome of a medallion sitting in a support fixture. With the thong threaded through the opening, a flap pressing element crimps the flap closed, thereby clamping the thong to the medallion. A knife is operated to cut the thong material at the correct length. Feed means for thong material is indexed to feed a fixed length of thong material through the receiving slot of the next medallion, which has previously been positioned for receiving the thong material. The process of manufacture is thereafter completed.

Accordingly, it is the primary object of the present invention to provide a decorative medallion with a thong securely fastened thereto.

It is a further object of the invention to provide such a medallion which is dome-shaped.

It is another object of the invention to facilitate automation of the assembly of a thong and a medallion.

It is another object of the invention to provide machinery which automates the assembly.

The foregoing and other objects and features of the invention will be apparent from the following description of a preferred embodiment of the medallion with a thong, the method of its fabrication and an apparatus for performing the method to fabricate the medallion.

BRIEF DESCRIPTION OF THE DRAWINGS

FIG. 1 is a front elevational view of a medallion with thong according to the present invention;

FIG. 2 is a side cross-sectional view along the line 2—2 in FIG. 1;

FIG. 3 is an opposite, rear exploded view of a medallion and thong according to the invention;

FIG. 4 is a side cross-sectional view along the line 4—4 in FIG. 3 showing the medallion before the thong is affixed thereto;

FIG. 5 is an enlarged, fragmentary view of the area of the medallion to which the thong is to be clamped.

DESCRIPTION OF A PREFERRED EMBODIMENT

Figure 6:
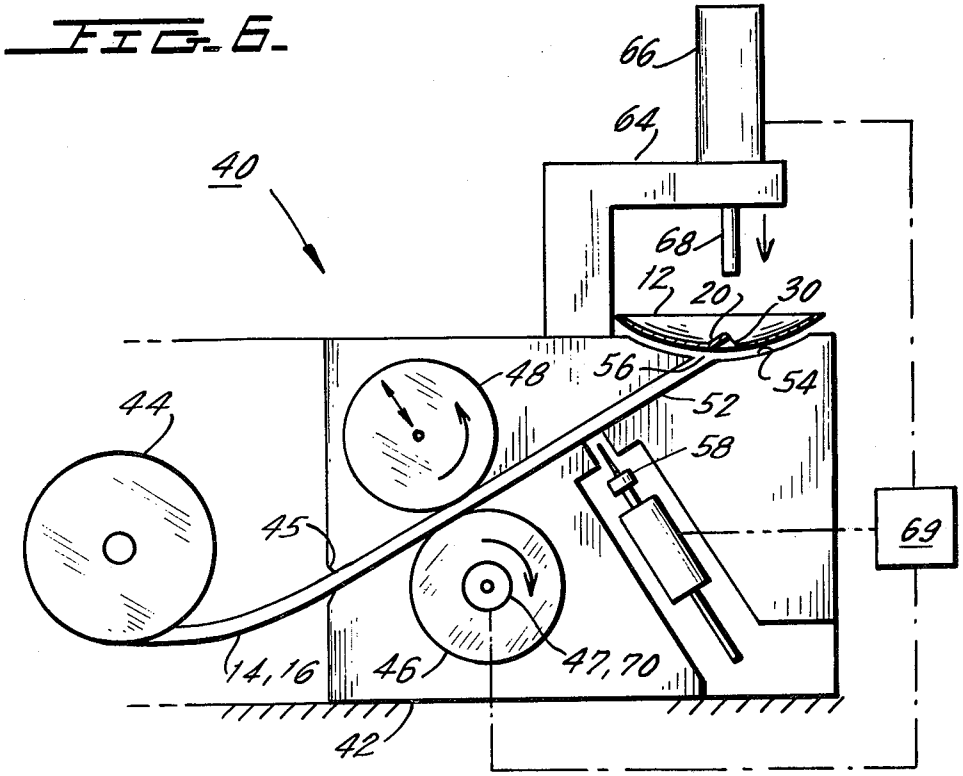
FIG. 6 is a schematic assembly view of apparatus for assembling a medallion and thong according to the invention, using a process according to the invention.

A medallion 10 according to the present invention includes the dome-shaped, thin metal, stamped piece 12 to which the two-ribbon thong 14, 16 is to be secured. Obviously, one or any number of ribbons or strands may be used for defining the thong. The thong comprises a length or lengths of leather, fabric or any appropriate, decorative, flexible, clampable material. In the prior art, it was conventional to simply stamp or punch a hole in the medallion and the thong was threaded through the hole. The thong would then have to be knotted, glued or otherwise fastened in place in a separate fastening step.

According to the present invention, the dome-shaped metal piece 12 is formed from a metal sheet, has a dished interior and is die stamped or punched to define a flap or louver 20. The flap 20 is bent out of the surface of the dome at fold 22 and into the interior of the curved dome defining the opening 30. The flap has straight, unbarbed side edges 24. The die (not shown) which forms the flap 20 is shaped so as not to make a straight cut at the free end 25 of the flap, but instead to define an edge, barb or hook 26 on the flap and also a cooperating edge, barb or hook 28 on the cut edge 32 of the domed metal piece 12. The barbs or hooks 26, 28 are adapted to strongly engage and clamp the thong 14, 16. After the thong, 14, 16 has been simply threaded through the opening 30, which is defined when the flap 20 is bent into the dome, the flap 20 is pushed or crimped by a die, stamp, or the like, back to its original, unbent condition, and this causes the hooks 26, 28 to tightly clamp the thong 14, 16, precluding subsequent removal of the thong from the metal piece 12 and completing the assembly of the medallion 10.

Apparatus 40 for assembling the medallion as described above and for performing the assembly method of the invention is now described. The apparatus 40 includes a main support frame 42. Thong material, e.g. leather, in one or more continuous webs or strands that are wound on the spool 44, are continuously unwound by the apparatus. A passageway 45 is defined through the housing 42 for the unwound thong to be fed through.

A feed roller 46 is supported in the apparatus and is rotated clockwise by means 47. Its surface is knurled to engage the thong. An idler roller 48 at the opposite side of the thong 14, 16 is spring biased to squeeze the thong against the drive roller 46, assuring that the thong will be driven. The thong is pushed by the rollers 46, 48 through the passageway 45 to the metal piece 12 to which the thong is to be attached.

The metal piece 12 sits in a fixture or die 54 shaped to support and position the piece and also to support it at its convex side when pressure is applied at its interior for crimping the thong, as described below. The passage 45 in the apparatus has an outlet 56 at the fixture 54, and the outlet 56 is positioned so that thong material exiting through the outlet will be fed into the opening 30 in the metal piece 12.

An air cylinder powered knife 58 is positioned along the pasageway 45 a distance selected so that the thong 14, 16, when cut, will have a preselected length. Also, the knife 58 includes blades oriented to make the beveled cuts 61, 63 at the exposed ends of the thong 14, 16 (FIGS. 1 and 3).

A jig 64 supports an air cylinder 66 which drives a crimping punch or stamp 68 down into the interior of the domed piece 12 to press and crimp the flap 20 back to its initial unbent position, thereby to clamp the thong 14, 16.

All of the feed roller 46, knife 58 and air cylinder 66 are connected with conventional timing control means 69 for properly sequencing their operation. Indexing means 70 attached to the feed roller drive 47 assure that a desired length of thong material is fed to the previously positioned medallion piece 12 prior to cutting the thong and clamping the thong.

The apparatus 40 described is operated in the following manner. First, a medallion piece 12, which already has a flap 20 formed in it, is positioned in the fixture 54 and is oriented in the fixture so that its flap 20 opens the opening 30 wider away from and as an extension of the passageway 45 past the outlet 56 of the passage. Next, the feed roller 46 indexes the thong material web up the passageway 45 past the knife 58 (by which the thong had previously been cut), through the exit 56 and a slight distance into the domed medallion piece through the opening 30. Then the feed roller 46 halts. The air cylinder 66 is now operated to drive the punch 68 against the flap 20 and clamp the thong 14, 16 to the medallion 12. Then the air cylinder operated knife 58 moves across the passageway 45 to cut off the thong to the desired length. Both the punch 68 and the knife 58 retract and the assembled, completed medallion 10 is removed from the fixture.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A medallion with attached thong, comprising:

a metallic medallion element having a flap defined within the periphery of the element, the flap being cut from the element, so that one edge of the flap remains attached to the element while the opposite edge of the flap is a free edge; the flap being tilted around the attached edge thereof, so that the free edge thereof is tilted out of one surface of the element, whereby the tilted flap defines an opening shaped to the size of the flap in the element into which opening a thong is insertable;

a thong of flexible material extending into the opening; the flap free edge includes a generally hook-like formation thereon for clamping into the thong, and as the flap is crimped toward an untilted orientation tnereof, the flap clamps onto the thong for retaining the thong to the element.

2. A medallion with attached thong, comprising:

a metallic medallion element having a flap defined within the periphery of the element, the flap being cut from the element, so that one edge of the flap remains attached to the element while the opposite edge of the flap is a free edge; the flap being tilted around the attached edge thereof, so that the free edge thereof is tilted out of one surface of the element, whereby the tilted flap defines an opening shaped to the size of the flap in the element into which a thong is insertable; the opening has and is defined by an edge which is placed for cooperating with the free edge of the flap;

a thong of flexible material extending into the opening, and the opening edge comprises a generally hook-like formation thereon for clamping into the thong and as the flap is crimped toward an untilted orientation thereof, the flap clamps onto the thong for retaining the thong to the element.

3. The medallion of either of claims 1, or 2 wherein the element is generally dome-shaped, with a dished interior and the flap is tilted into the interior of the dome.

4. The medallion of either of claims 1, or 2 wherein the thong is comprised of leather.

5. A method of assembling a thong to a metallic element, to define a thonged medallion, comprising:

cutting a flap into a metallic element for defining an opening within the periphery of the element, the flap being cut from the element so that one edge of the flap remains attached to the element while the opposite edge of the flap is a free edge; while cutting the flap, also defining a hook-like formation on the opposite free edge of the flap for securely gripping a thong, tilting the flap around the attached edge thereof for moving the opposite free edge thereof to tilt out of one surface of the element, so that the tilted flap defines an opening in the element into which a thong is insertable;

the method comprising inserting a thong of flexible material into the opening at the flap, and then crimping the flap back toward its untilted orientation for clamping the flap on the thong for retaining the thong to the element.

6. The method of claim 5, further comprising, at the edge of the opening from which the free edge of the flap is cut, while cutting the flap, also defining a hook-like formation on the edge of the opening for securely gripping the thong when the flap is tilted back to the untilted orientation.

7. The method of either of claims 5 or 6, wherein the element is dome-shaped and the flap is tilted into the dished open space defined under the dome shape of the element.

8. The method of claim 5, wherein the step of inserting the thong comprises feeding a continuous web of thong material to the element and into the opening of the element, and then halting the feeding; and cutting a predetermined length of thong material from the continuous web thereof after the thong material has been fed into the opening in the element.

* * * * *